US011668180B2

(12) United States Patent
Zha et al.

(10) Patent No.: US 11,668,180 B2
(45) Date of Patent: Jun. 6, 2023

(54) SYSTEM AND METHOD FOR STICK-SLIP VIBRATION MITIGATION

(71) Applicant: ConocoPhillips Company, Houston, TX (US)

(72) Inventors: Yang Zha, Houston, TX (US); Son V. Pham, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 1005 days.

(21) Appl. No.: 16/240,429

(22) Filed: Jan. 4, 2019

(65) Prior Publication Data

US 2019/0211665 A1 Jul. 11, 2019

Related U.S. Application Data

(60) Provisional application No. 62/613,986, filed on Jan. 5, 2018.

(51) Int. Cl.

| | |
|---|---|
| ***E21B 44/08*** | (2006.01) |
| *E21B 44/00* | (2006.01) |
| *E21B 28/00* | (2006.01) |

(52) U.S. Cl.

CPC ..... *E21B 44/08* (2013.01); *E21B 28/00* (2013.01); *E21B 44/00* (2013.01)

(58) Field of Classification Search

CPC ..... E21B 44/08

See application file for complete search history.

(56) References Cited

U.S. PATENT DOCUMENTS

| | | | | |
|---|---|---|---|---|
| 5,360,738 | A | 11/1994 | Jones et al. | |
| 6,799,117 | B1 | 9/2004 | Proett et al. | |
| 8,453,764 | B2 * | 6/2013 | Turner | G05B 23/0243 702/9 |
| 9,022,145 | B2 * | 5/2015 | Rodney | E21B 47/024 175/56 |
| 10,822,939 | B2 * | 11/2020 | Hohl | E21B 44/00 |
| 2011/0232966 | A1 | 9/2011 | Kyllingstad | |
| 2013/0277110 | A1 | 10/2013 | Doris | |
| 2015/0083493 | A1 * | 3/2015 | Wassell | E21B 44/00 702/9 |
| 2015/0240615 | A1 * | 8/2015 | Dykstra | E21B 44/005 700/275 |
| 2016/0138382 | A1 | 5/2016 | Badkoubeh et al. | |
| 2017/0268324 | A1 * | 9/2017 | Moore | E21B 47/00 |

FOREIGN PATENT DOCUMENTS

| | | | |
|---|---|---|---|
| CN | 107450322 | A | 12/2017 |
| WO | WO-2010064031 | A1 | 6/2010 |
| WO | WO-2014147116 | A1 | 9/2014 |
| WO | WO-2017/160272 | A1 | 9/2017 |

OTHER PUBLICATIONS

Supplementary European Search Report for Application No. EP 19 73 5728 dated Sep. 13, 2021 (9 pages).

The International Search Report and The Written Opinion of The International Searching Authority for International Application No. PCT/US 19/12390 dated Apr. 2, 2019 (13 pages).

* cited by examiner

*Primary Examiner* — Nicole Coy

(74) *Attorney, Agent, or Firm* — Polsinelli PC

(57) ABSTRACT

A stick-slip vibration mitigation system and a method of using the system are provided. The system includes a sensor, a processor, a non-transitory storage medium, and a controller. The system is operable to be used with a drill-string in a wellbore during a drilling process to mitigate stick-slip vibration of the drill-string.

12 Claims, 10 Drawing Sheets

Data flow of the Stick-slip mitigation system

Data flow of the Stick-slip mitigation system

500

600

SYSTEM AND METHOD FOR STICK-SLIP VIBRATION MITIGATION

CROSS-REFERENCE TO RELATED APPLICATION

This application claims the benefit of U.S. Provisional Application Ser. No. 62/613,986, filed Jan. 5, 2018, which is incorporated herein by reference in its entirety.

BACKGROUND

1. Field of the Invention

The present inventive concept relates to a system and method to mitigate vibration of a drill-string during a drilling process. In particular, the present inventive concept concerns a system operable to obtain data regarding stick-slip vibration of the drill-string during the drilling process, and process the data to mitigate the stick-slip vibration, and a method of using the system.

2. Description of Related Art

A drill-string of a drilling rig can exhibit a variety of vibrations during use that may damage the drill-string and/or the drilling rig. One particular type of vibration, known as stick-slip vibration, occurs when a drill bit at a bottom of the drill-string is rotating at a different angular speed than a top drive motor at the top of the drill-string, which is typically caused by friction in the wellbore. When stick-slip vibration occurs, portions of the drill-string can completely stick to the formation, while the upper portion of the drill-string continues to rotate. When a portion of the drill-string that is stuck overcomes the static friction of the formation, the drill-string will suddenly speed up and release the stored energy, which can damage the drill bit, the drill-string, and/or the drilling rig, thereby increasing drilling costs.

Conventional systems attempt to reduce stick-slip vibration by reducing the lowest frequency of the stick-slip vibration. This conventional approach is ineffective when a higher frequency exhibits a stronger or comparable energy level than the lowest frequency, which is a common scenario. In such a scenario, while the lower frequency of the vibration is reduced, the higher frequency remains strong, which results in continued stick-slip vibration.

Accordingly, there is a need for an improved system and method to mitigate stick-slip vibration.

SUMMARY

The present inventive concept provides a system and method for stick-slip vibration mitigation. The system generally includes a sensor, a processor, a non-transitory storage medium, and a controller. The system is operable to be used with a drill-string in a wellbore to obtain stick-slip vibration data of the drill-string and calculate a controller setting based on the stick-slip vibration data to mitigate the stick-slip vibration. The method provides steps to reduce the stick-slip vibration using the system. The system of the present inventive concept advantageously mitigates stick-slip vibration by targeting and reducing multiple vibration modes of the stick-slip vibration during the drilling process, thereby improving efficiency of the drilling process.

The aforementioned may be achieved in an aspect of the present inventive concept by providing a system configured to mitigate vibration in a drill-string. The system may include a sensor configured to measure a torque of the drill-string. The sensor may be configured to yield measurement data. The system may further include a processor configured to determine a plurality of vibration modes using the measurement data. The process may be configured to determine a frequency and an amplitude of each the plurality of vibration modes. The processor may be configured to determine a controller setting via minimization of an objective function based on a reflectivity of vibrations energy at the plurality of vibration modes. The controller setting may be configured to reduce at least one of the plurality of vibration modes, preferably a plurality of the plurality of vibration modes, and most preferably all of the plurality of vibration modes. The system may further include a controller configured to control the drill-string based on the controller setting to mitigate the plurality of vibration modes.

The system may further include a non-transitory storage medium configured to store program logic for execution by the processor. The processor may be configured to execute the program logic to determine an optimization of the controller setting based on the frequency and the amplitude of each of the plurality of vibration modes, wherein the optimization includes reducing the reflectivity of vibrations energy at one of the plurality of vibration modes and limiting a dampening of another of the plurality of vibration modes.

Using the program logic, the processor may be configured to obtain a reflectivity of torsional waves at a top drive of the drill-string. Using the program logic, the processor may be configured to obtain the objective function as a weighted sum of reflectivity at each frequency plus a width of an absorption band. Using the program logic, the processor may be configured to solve the optimization numerically by applying a numerical minimization method and yielding a PID control. Using the program logic, the processor may be configured to determine an RPM command based on the PID control. Using the program logic, the processor may be configured to calculate the RPM command in a time domain. Using the program logic, the processor may be configured to calculate the RPM command in a frequency domain.

The non-transitory storage medium may be configured to store a delay program logic for execution by the processor. The processor may be configured to execute the delay program logic to determine the optimization of the controller setting based on the frequency and the amplitude of each of the plurality of vibration modes. Using the delay program logic, the processor may be configured to determine a time delay by comparing the controller setting to an actual controller setting by determining a cross-correlation between a first signal of the controller setting and a second signal of the actual controller setting in a moving window. Using the delay program logic, the processor may be configured to select a time lag corresponding to a maximum of the cross-correlation as the time delay. Using the delay program logic, the processor may be configured to convert the time delay to a phase shift. Using the delay program logic, the processor may be configured to apply the phase shift to the first signal to offset the effect of the delay. Using the delay program logic, the processor may be configured to calculate the phase shift. The controller may be configured to apply the phase shift to a spectra of the controller setting.

The aforementioned may be achieved in another aspect of the present inventive concept by providing a method to mitigate vibration in a drill-string. The method may include the step of measuring, via a sensor, a drill-string torque to yield measurement data. The method may further include the step of determining, via a processor, a plurality of vibration modes using the measurement data. The step of determining the plurality of vibration modes via the processor may include performing a spectral analysis on the measurement data. The step of processing the measurement data may use a Maximum Entropy method to determine a spectral content of the measurement data during the spectral analysis.

The method may further include the step of determining, via the processor, the frequency and the amplitude of each of the plurality of vibration modes.

The method may further include the step of determining, via the processor, a controller setting via a minimization of an objective function based on a reflectivity of vibration energy of the plurality of vibration modes. The step of determining the controller setting may include performing an optimization of the measurement data based on the frequency and the amplitude of each of the plurality of vibration modes, wherein the optimization may include (i) reducing the reflectivity of vibration energy at one of the plurality of vibration modes, and (ii) limiting a dampening of another of the plurality of vibration modes. The optimization may be performed by calculating a reflectivity of torsional waves at a top drive of the drill-string. The optimization may be performed by obtaining the objective function as a weighted sum of reflectivity at each frequency plus a width of an absorption band. The optimization may include solving the optimization numerically by applying a numerical minimization method to yield a PID control. The numerical minimization method may be a quasi-Newton scheme.

The method may further include the step of controlling, via a controller, the drill-string based on the controller setting to mitigate the plurality of vibration modes. The controller setting may be configured to reduce at least one of the plurality of vibration modes, preferably a plurality of the plurality of vibration modes, and most preferably all of the plurality of vibration modes.

The method may further include the step of determining, via the processor, an RPM command based on the PID control. The step of determining the RPM command may include calculating, via the processor, the RPM command in a time domain. The step of determining the RPM command may include the step of calculating, via the processor, the RPM command in a frequency domain.

The method may further include the step of applying, via the processor, a delay program logic to the controller setting. The delay program logic may include the step of determining, via the processor, a time delay by comparing the controller setting to an actual controller setting by determining a cross-correlation between a first signal of the controller setting and a second signal of the actual controller setting in a moving window. The delay program logic may further include the step of selecting, via the processor, a time lag corresponding to a maximum of the cross-correlation as the time delay. The delay program logic may further include the step of converting, via the processor, the time delay to a phase shift. The delay program logic may further include the step of applying, via the controller, the phase shift to the first signal to offset the effect of the delay. The phase shift may be calculated via the processor. The phase shift may be applied, via the controller, to a spectra of the controller setting.

The aforementioned may be achieved in another aspect of the present inventive concept by providing a method to mitigate vibration in a drill-string. The method may include the step of measuring, via a sensor, torque of a drill-string to yield measurement data. The method may further include the step of performing, via a processor, a spectral analysis of the measurement data to yield a spectral content. The method may further include the step of determining, via the processor, a plurality of vibration modes using the spectral content. Each of the plurality of vibration modes may have a frequency and an amplitude. The method may further include the step of determining, via the processor, an objective function as a weighted sum of reflectivity at each frequency of the plurality of vibration modes plus a width of an absorption band. The method may further include the step of determining, via the processor, a controller setting via a minimization of the objective function. The method may further include the step of applying, via the processor, a delay program logic to the controller setting if a time delay is identified between the controller setting and an actual controller setting. The method may further include the step of controlling, via a controller, a top drive based on the controller setting to mitigate the plurality of vibration modes.

The aforementioned may be achieved in another aspect of the present inventive concept by providing a system configured to mitigate vibration in a drill-string. The system may include a sensor configured to measure torque of a drill-string and/or yield measurement data. The system may include a processor configured via program logic to perform a spectral analysis of the measurement data to yield a spectral content. The processor may be further configured via the program logic to determine a plurality of vibration modes using the spectral content. Each of the plurality of vibration modes may have a frequency and an amplitude. The processor may be further configured via the program logic to determine an objective function as a weighted sum of reflectivity at each frequency of the plurality of vibration modes plus a width of an absorption band. The processor may be further configured via the program logic to determine a controller setting via a minimization of the objective function. The processor may be further configured via the program logic to apply delay program logic to the controller setting if a time delay is associated with the controller setting. The system may include a non-transitory storage medium configured to store the program logic and the delay program logic. The system may include a controller configured to control the drill-string, e.g., a top drive of the drill-string, based on the controller setting to mitigate the plurality of vibration modes.

The aforementioned may be achieved in another aspect of the present inventive concept by providing a method to determine a plurality of frequencies of a drill-string. The method may include the step of measuring, via a sensor, a drill-string torque of a drill-string to yield measurement data. The method may further include the step of determining, via a processor, a plurality of vibration modes using the measurement data. The method may further include the step of determining, via the processor, a frequency and an amplitude of each of the plurality of vibration modes.

The aforementioned may be achieved in another aspect of the present inventive concept by providing a method to optimize measurement data of a drill-string. The method may include the step of measuring, via a sensor, a drill-string torque of a drill-string to yield measurement data. The method may further include the step of determining, via a processor, a plurality of vibration modes of the drill-string using the measurement data. The method may include the step of determining, via a processor, a plurality of vibration modes of a drill-string. The method may further include the step of determining, via the processor, a controller setting via a minimization of an objective function based on a reflectivity of vibration energy of the plurality of vibration modes. The method may further include the step of determining, via the processor, the controller setting via an optimization of the measurement data based on the frequency and the amplitude of each of the plurality of vibration modes.

The aforementioned may be achieved in another aspect of the present inventive concept by providing a method to control a top drive of a drill-string. The method may include the step of determining, via a processor, a plurality of vibration modes of a drill-string. The method may further include the step of determining, via the processor, a controller setting via a minimization of an objective function based on a reflectivity of vibration energy of the plurality of vibration modes. The method may further include the step of controlling, via a controller, the drill-string based on the controller setting to mitigate the plurality of vibration modes.

The aforementioned may be achieved in another aspect of the present inventive concept by providing a method to mitigate vibration in a drill-string. The method may include the step of measuring, via a sensor, a drill-string torque of a drill-string to yield measurement data. The method may further include the step of determining, via a processor, a plurality of vibration modes using the measurement data. The method may further include the step of determining, via the processor, a frequency and an amplitude of each of the plurality of vibration modes. The method may further include the step of determining, via the processor, a controller setting via a minimization of an objective function based on a reflectivity of vibration energy of the plurality of vibration modes. The method may further include the step of determining, via the processor, the controller setting via an optimization of the measurement data based on the frequency and the amplitude of each of the plurality of vibration modes. The method may further include the step of controlling, via a controller, the drill-string based on the controller setting to mitigate the plurality of vibration modes.

The aforementioned may be achieved in another aspect of the present inventive concept by providing a system configured to determine a plurality of frequencies of a drill-string. The system may include a sensor configured to measure a drill-string torque of a drill-string to yield measurement data. The system may further include a processor configured to determine a plurality of vibration modes using the measurement data. The system may further include the processor configured to determine a frequency and an amplitude of each of the plurality of vibration modes.

The aforementioned may be achieved in another aspect of the present inventive concept by providing a system configured to optimize measurement data of a drill-string. The system may include a sensor configured to measure a drill-string torque of a drill-string to yield measurement data. The system may further include a processor configured to determine a plurality of vibration modes of the drill-string using the measurement data. The processor may further be configured to determine a controller setting via a minimization of an objective function based on a reflectivity of vibration energy of the plurality of vibration modes. The processor may further be configured to determine the controller setting via an optimization of the measurement data based on the frequency and the amplitude of each of the plurality of vibration modes.

The aforementioned may be achieved in another aspect of the present inventive concept by providing a system operable to control a top drive of a drill-string. The system may include a processor configured to determine a plurality of vibration modes of a drill-string. The processor may be further configured to determine a controller setting via a minimization of an objective function based on a reflectivity of vibration energy of the plurality of vibration modes. The system may further include a controller configured to control the top drive of the drill-string based on the controller setting to mitigate the plurality of vibration modes.

The aforementioned may be achieved in another aspect of the present inventive concept by providing a system configured to mitigate vibration in a drill-string. The system may include a sensor configured to measure a drill-string torque of a drill-string to yield measurement data. The system may further include a processor configured to determine a plurality of vibration modes using the measurement data. The processor may be further configured to determine a frequency and an amplitude of each of the plurality of vibration modes. The processor may be further configured to determine a controller setting via a minimization of an objective function based on a reflectivity of vibration energy of the plurality of vibration modes. The processor may be further configured to determine a controller setting via a minimization of an objective function based on a reflectivity of vibration energy of the plurality of vibration modes. The system may further include a controller configured to control the top drive of the drill-string based on the controller setting to mitigate the plurality of vibration modes.

The foregoing is intended to be illustrative and is not meant in a limiting sense. Many features of the embodiments may be employed with or without reference to other features of any of the embodiments. Additional aspects, advantages, and/or utilities of the present inventive concept will be set forth in part in the description that follows and, in part, will be apparent from the description, or may be learned by practice of the present inventive concept.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the present inventive concept is not limited to the precise embodiments and features shown. The accompanying drawings, which are incorporated in and constitute a part of this specification, illustrate an implementation of apparatuses consistent with the present inventive concept and, together with the description, serve to explain advantages and principles consistent with the present inventive concept.

FIG. 6 is a graph illustrating the reflectivity profile when the fundamental mode and the first higher mode are similar;

DETAILED DESCRIPTION

Figure 1:
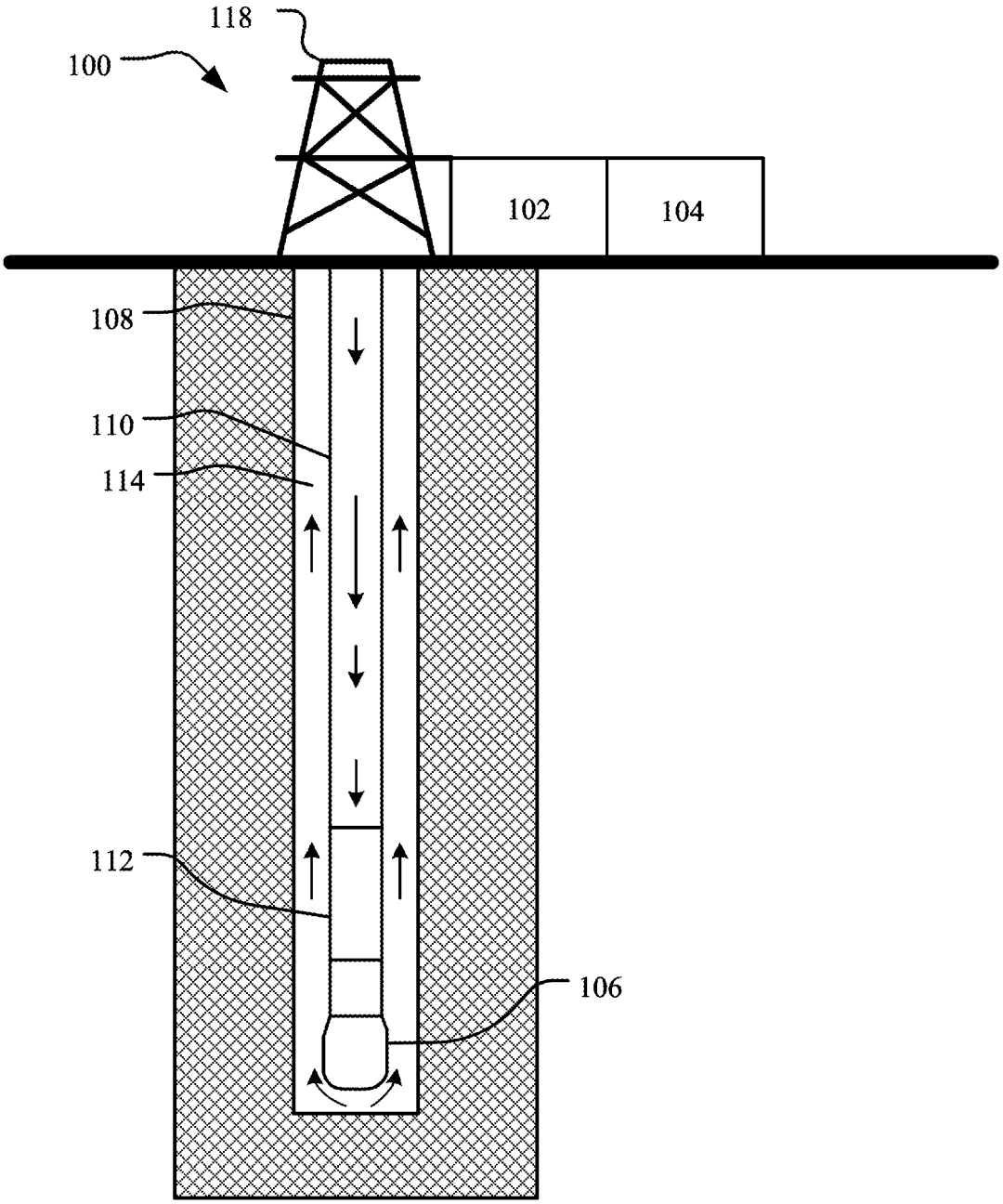
FIG. 1 is a diagram illustrating a stick-slip vibration mitigation system of the present inventive concept with a drilling rig, a drill-string sensor, and supporting facilities in use with a wellbore and drill-string.

The following detailed description references the accompanying drawing that illustrates various embodiments of the present inventive concept. The illustration and description are intended to describe aspects and embodiments of the present inventive concept in sufficient detail to enable those skilled in the art to practice the present inventive concept. Other components can be utilized and changes can be made without departing from the scope of the present inventive concept. The following detailed description is, therefore, not to be taken in a limiting sense. The scope of the present inventive concept is defined only by the appended claims, along with the full scope of equivalents to which such claims are entitled.

I. Terminology

The phraseology and terminology employed herein are for the purpose of description and should not be regarded as limiting. For example, the use of a singular term, such as, "a" is not intended as limiting of the number of items. Also, the use of relational terms such as, but not limited to, "top," "bottom," "left," "right," "upper," "lower," "down," "up," and "side," are used in the description for clarity in specific reference to the figures and are not intended to limit the scope of the present inventive concept or the appended claims. Further, it should be understood that any one of the features of the present inventive concept may be used separately or in combination with other features. Other systems, methods, features, and advantages of the present inventive concept will be, or become, apparent to one with skill in the art upon examination of the figures and the detailed description. It is intended that all such additional systems, methods, features, and advantages be included within this description, be within the scope of the present inventive concept, and be protected by the accompanying claims.

The present disclosure is described below with reference to operational illustrations of methods and devices. It is understood that each operational illustration and combination of operational illustrations can be implemented by means of analog or digital hardware and computer program instructions. The computer program instructions can be provided to a processor of a general purpose computer, special purpose computer, ASIC, or other programmable data processing apparatus, such that the instructions, which execute via the processor of the computer or other programmable data processing apparatus, implement the functions/acts specified in the operational illustrations or diagrams.

Further, it is understood that the specific order or hierarchy of steps in the methods disclosed are instances of example approaches. Based upon design preferences, it is understood that the specific order or hierarchy of steps in the method can be rearranged while remaining within the disclosed subject matter. The accompanying method claims present elements of various steps in a sample order, and are not necessarily meant to be limited to the specific order or hierarchy presented.

For the purposes of this disclosure, "program logic" refers to computer program code and/or instructions in the form of one or more software modules, such as executable code in the form of an executable application, an application programming interface (API), a subroutine, a function, a procedure, an applet, a servlet, a routine, source code, object code, a shared library/dynamic load library, or one or more instructions. These software modules may be stored in any type of a suitable non-transitory storage medium, or transitory storage medium, e.g., electrical, optical, acoustical, or other form of propagated signals such as carrier waves, infrared signals, or digital signals.

For the purposes of this disclosure, a non-transitory storage medium or computer readable medium (or computer-readable storage medium/media) stores computer data, which data can include program logic (or computer-executable instructions) that is executable by a computer, in machine readable form. By way of example, a computer readable medium may comprise computer readable storage media, for tangible or fixed storage of data, or communication media for transient interpretation of code-containing signals. Computer readable storage media, as used herein, refers to physical or tangible storage (as opposed to signals) and includes without limitation volatile and non-volatile, removable and non-removable media implemented in any method or technology for the tangible storage of information such as computer-readable instructions, data structures, program modules or other data. Computer readable storage media includes, but is not limited to, RAM, ROM, EPROM, EEPROM, flash memory or other solid state memory technology, CD-ROM, DVD, or other optical storage, magnetic cassettes, magnetic tape, magnetic disk storage or other magnetic storage devices, or any other physical or material medium which can be used to tangibly store the desired information or data or instructions and which can be accessed by a computer or processor.

For purposes of this disclosure, a "wireless network" should be understood to couple devices with a network. A wireless network may employ stand-alone ad-hoc networks, mesh networks, Wireless LAN (WLAN) networks, cellular networks, or the like. A wireless network may further include a system of terminals, gateways, routers, or the like coupled by wireless radio links, or the like, which may move freely, randomly or organize themselves arbitrarily, such that network topology may change, at times even rapidly. A wireless network may further employ a plurality of network access technologies, including Long Term Evolution (LTE), WLAN, Wireless Router (WR) mesh, or 2nd, 3rd, or 4th generation (2G, 3G, or 4G) cellular technology, or the like. Network access technologies may enable wide area coverage for devices, such as client devices with varying degrees of mobility, for example.

For example, a network may enable RF or wireless type communication via one or more network access technologies, such as Global System for Mobile communication (GSM), Universal Mobile Telecommunications System (UMTS), General Packet Radio Services (GPRS), Enhanced Data GSM Environment (EDGE), 3GPP Long Term Evolution (LTE), LTE Advanced, Wideband Code Division Multiple Access (WCDMA), North American/CEPT frequencies, radio frequencies, single sideband, radiotelegraphy, radioteletype (RTTY), Bluetooth, 802.11b/g/n, or the like. A wireless network may include virtually any type of wireless communication mechanism by which signals may be communicated between devices, such as a client device or a computing device, between or within a network, or the like.

Further, as the present inventive concept is susceptible to embodiments of many different forms, it is intended that the present disclosure be considered as an example of the principles of the present inventive concept and not intended to limit the present inventive concept to the specific embodiments shown and described. Any one of the features of the present inventive concept may be used separately or in combination with any other feature. References to the terms "embodiment," "embodiments," and/or the like in the description mean that the feature and/or features being referred to are included in, at least, one aspect of the description. Separate references to the terms "embodiment," "embodiments," and/or the like in the description do not necessarily refer to the same embodiment and are also not mutually exclusive unless so stated and/or except as will be readily apparent to those skilled in the art from the description. For example, a feature, structure, process, step, action, or the like described in one embodiment may also be included in other embodiments, but is not necessarily included. Thus, the present inventive concept may include a variety of combinations and/or integrations of the embodiments described herein. Additionally, all aspects of the present disclosure, as described herein, are not essential for its practice. Likewise, other systems, methods, features, and advantages of the present inventive concept will be, or become, apparent to one with skill in the art upon examination of the figures and the description. It is intended that all such additional systems, methods, features, and advantages be included within this description, be within the scope of the present inventive concept, and be encompassed by the claims.

Lastly, the terms "or" and "and/or," as used herein, are to be interpreted as inclusive or meaning any one or any combination. Therefore, "A, B or C" or "A, B and/or C" mean any of the following: "A," "B," "C"; "A and B"; "A and C"; "B and C"; "A, B and C." An exception to this definition will occur only when a combination of elements, functions, steps or acts are in some way inherently mutually exclusive.

II. General Architecture

Figure 2:
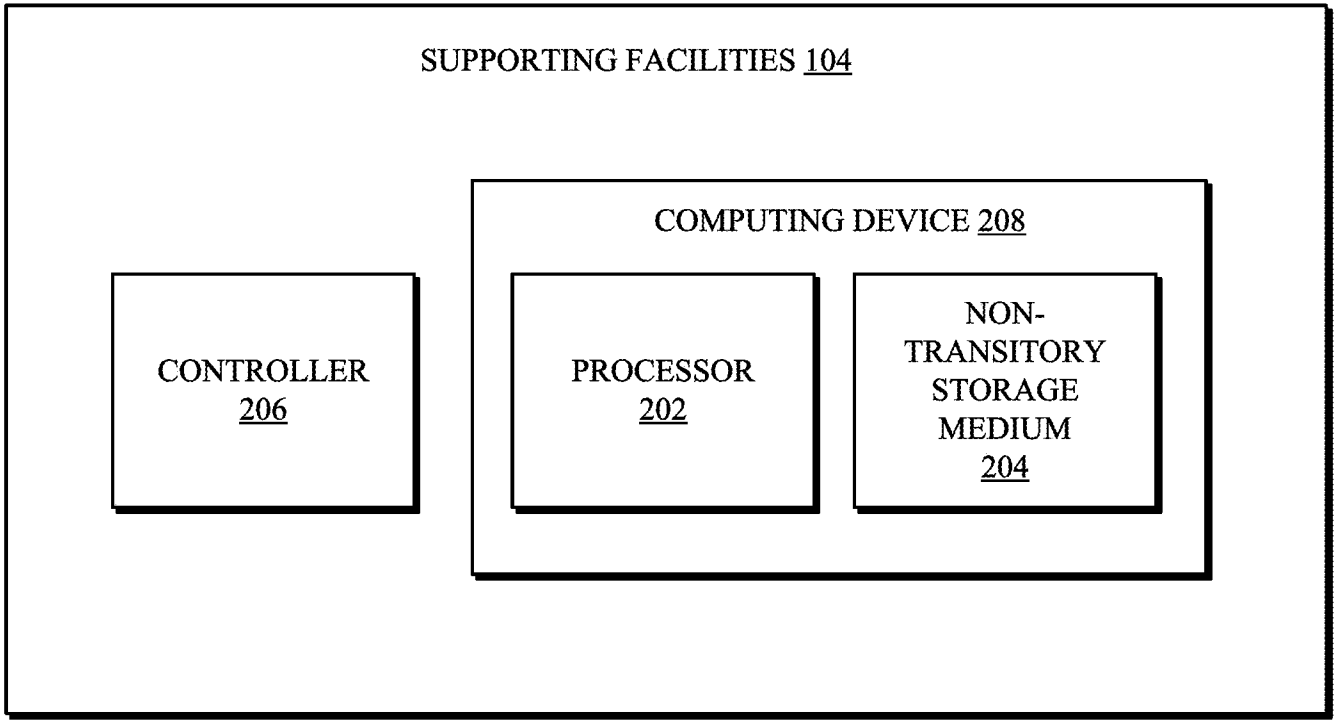
FIG. 2 is a diagram of the supporting facilities of FIG. 1 having a computing device and a controller.
Figure 3:
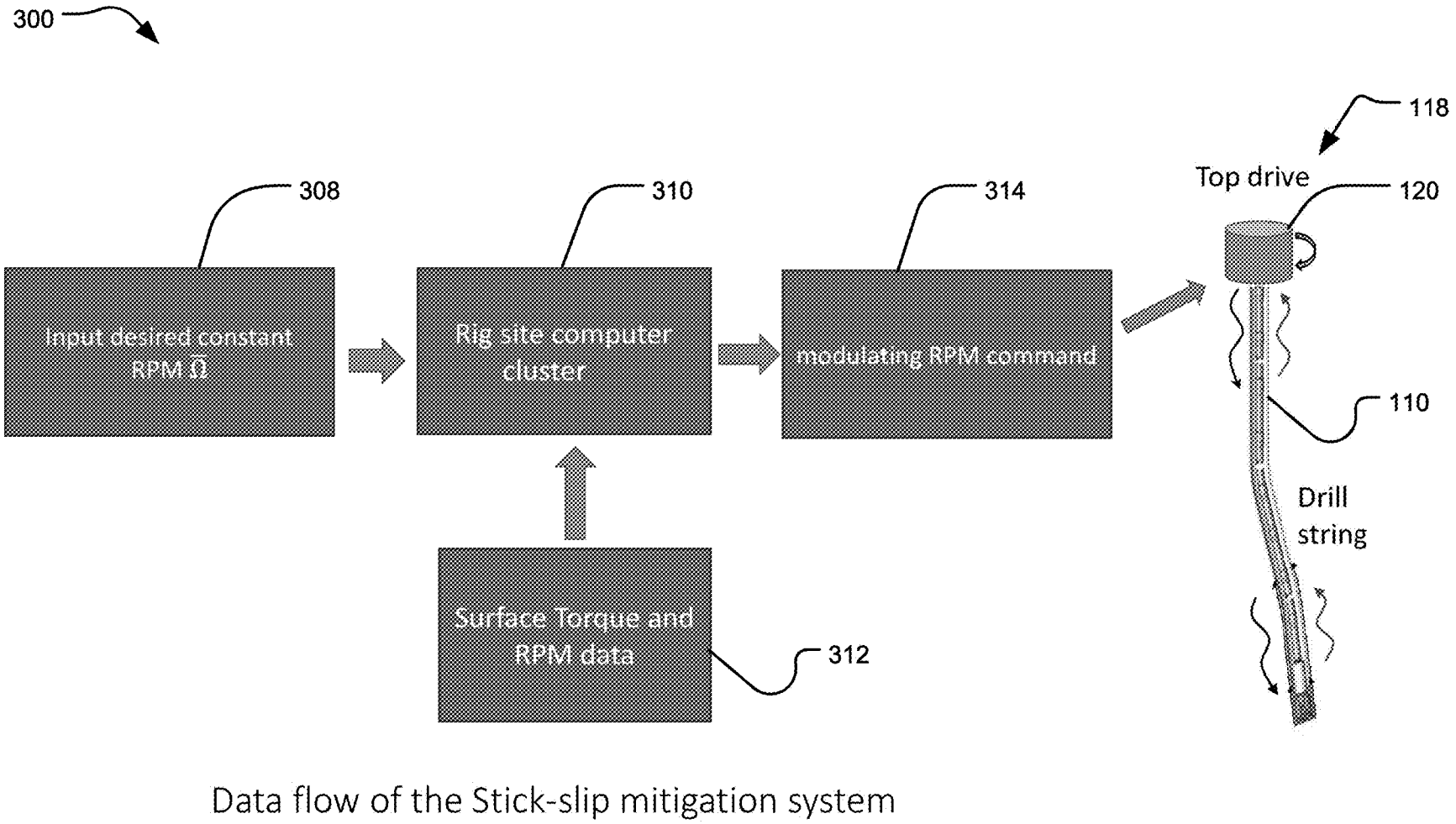
FIG. 3 is a diagram of a data flow of the stick-slip vibration mitigation system, illustrated in FIG. 1, to a top drive of the drilling rig.

Turning to FIGS. 1-3, a stick-slip vibration mitigation system 100 of the present inventive concept is illustrated in use with a drilling rig 118 having a top drive motor 120 at a surface of a wellbore 108. The drilling rig 118 includes a drill-string 110 extending into the wellbore 108 with a drill-string sensor 102 and supporting facilities 104 positioned at a top of the wellbore 108. The wellbore 108 extends into the ground and is formed via a drilling process using the drill-string 110. A depth of the wellbore 108 can range from a few feet to over a mile into the ground and can extend in one or more directions. The drill-string 110 includes a drill pipe and a bottom hole assembly (BHA) 112 positioned at a bottom of the drill-string 110. The BHA 112 includes a plurality of components. In the exemplary embodiment, the BHA 112 includes a steering unit, a mud motor, a drill motor, a drill collar, and a drill bit 106. It is foreseen that the BHA 112 may include fewer or additional components without deviating from the scope of the present inventive concept. The drill-string 110 extends into the wellbore 108 so that the bit 106 of the BHA 112 is in contact with a geological formation to crush and/or scrape the geological formation, thereby increasing a length of the wellbore 108 in a downward direction and/or a lateral direction. In the exemplary embodiment, the bit 106 is driven by the top drive 120 and/or the mud motor positioned near the bit 106.

A drilling mud or a drilling fluid 114 is continuously circulated within the wellbore 108 via a pump to facilitate operation of the BHA 112, e.g., drilling. The fluid 114 is introduced into the drill-string 110 via an opening of the drill-string 110 and pumped down the drill-string 110 and through the BHA 112 via the pump. The fluid 114 exits the drill-string 110 through the bit 106 and circulates upwards through an annulus of the wellbore 108. The fluid 114 has multiple functions including, but not limited to, cooling the bit 106, lubricating the bit 106, and/or transporting debris generated by the bit 106 away from the bit 106, e.g., up the annulus of the wellbore 108 and to the surface of the wellbore 108. The fluid 114 may be water, oil, a synthetic based composition, gas, or a combination thereof, and may include one or more additives and/or particles.

The drill-string sensor 102 is configured to measure a torque of the drill-string 110 and yield measurement data of the drill-string torque. It is foreseen that the drill-string sensor 102 may be configured to measure acceleration and speed without deviating from the scope of the present inventive concept. It is foreseen that the drill-string sensor 102 may be, or include, a strain gauge, accelerometer, gyroscope, and/or seismometer without deviating from the scope of the present inventive concept. It is foreseen that the torque may be measured as a high-fidelity measurement.

In the exemplary embodiment, the drill-string sensor 102 is positioned at or adjacent to the top of the drill-string 110, but it is foreseen that the drill-string sensor 102 can be positioned along any portion of the drill-string 110 without deviating from the scope of the present inventive concept. For instance, it is foreseen that the drill-string sensor 102 can be positioned on the BHA 112 or in a sub positioned under the top drive 120 without deviating from the scope of the present inventive concept.

The supporting facilities 104 include a controller 206 and a computing device 208. The computing device 208 includes a processor 202 and a non-transitory storage medium 204. In the exemplary embodiment, the measurement data is transmitted from the drill-string sensor 102 to the non-transitory storage medium 204 via a wireless connection of a wireless network, although it is foreseen that the measurement data can be transmitted to the non-transitory storage medium 204 via a wired connection without deviating from the scope of the present inventive concept. The non-transitory storage medium 204 tangibly stores the measurement data for processing by the processor 202.

The processor 202 is configured to process the measurement data by executing program logic, which is also stored by the non-transitory storage medium 204. Using the program logic, the processor 202 is configured to determine at least one vibration mode using the measurement data. In the exemplary embodiment, the at least one vibration mode is a plurality of vibration modes, but it is foreseen that the at least one vibration mode can be a single vibration mode without deviating from the scope of the present inventive concept.

Using the program logic, the processor 202 is also configured to determine a frequency and an amplitude of each of the plurality of vibration modes. Using the program logic, the processor 202 is also configured to determine a controller setting that is effective to reduce at least one of the plurality of vibration modes via minimization of an objective function based on a total reflectivity of vibration energy at all of the plurality of vibration modes and a width of an absorption band. In the exemplary embodiment, the controller setting is effective to reduce at least one of the plurality of vibration modes, preferably a plurality of the plurality of vibration modes, and most preferably all of the plurality of vibration modes.

The controller 206 is configured to receive the controller setting from the processor 202, and modify one or more drilling parameters of the drill-string 110 via the top drive 120. In this manner, application of the controller setting via the drill-string 110 is effective to reduce stick-slip vibration. Regarding the one or more drilling parameters, in the exemplary embodiment, the controller setting is converted to a rotations-per-minute (RPM) command 314, via the processor 202, which is effective to cause the top drive 120 to rotate the drill-string 110 at a speed measured in RPMs. By adjusting the RPM of the top drive 120 using the RPM command 314, the stick-slip vibration can be mitigated, i.e., at least reduced and preferably eliminated from the drill-string 110, via the system 100.

FIG. 3 illustrates a data flow 300 of the system 100. A desired RPM input 308 is entered into the computing device 208 by a user of the system 100 and stored in the non-transitory storage medium 204. The measurement data of the drill-string 110 torque from the drill-string sensor 102 and/or RPM data 312 are received by the non-transitory storage medium 204 of the computing device 208. The RPM data 312 is the RPM measured by the drill-string sensor 102 at the top drive 120. The processor 202 of the computing device 208 calculates the RPM command 314 based on the desired RPM input 308, and the measurement data and the RPM data 312. The RPM command 314 is transmitted from the computing device 208 to the controller 206. The controller 206 controls the top drive 120 via a wireless connection of the wireless network. It is foreseen that the RPM command 314 can be transmitted to the top drive 120 or otherwise controlled by the controller 206 via a wired connection without deviating from the scope of the present inventive concept.

With reference to FIGS. 1-3, a method of using the system 100 to mitigate stick-slip vibration is as follows. The method includes the step of measuring, via the drill-string sensor 102, the drill-string torque to yield the measurement data. The method of using the system 100 further includes the step of determining, via the processor 202, the at least one vibration mode using the measurement data. The measurement data is measured in real-time via the drill-string sensor 102 and transmitted to the processor 202 in real-time. In the exemplary embodiment, the measurement data is measured and transmitted at a high sampling rate that is decimated to a sampling rate, but it is foreseen the measurement data may be measured and transmitted in other forms without deviating from the scope of the present inventive concept.

During the step of determining the at least one vibration mode, the measurement data is partitioned into overlapping moving windows, wherein the span of the moving windows is longer than a longest period of interest. The step of determining the at least one vibration mode further includes performing, via the processor 202, a spectral analysis on the measurement data. The spectral analysis uses a Maximum Entropy method, which is used for short time series with discrete frequency content, to determine a spectral content of the measurement data. It is foreseen that other methods may be used in the spectral analysis such as, but not limited to a Fourier Transform, without deviating from the scope of the present inventive concept. The spectrum content corresponds to a most random time series whose autocorrelation agrees with the measurement data. The spectral analysis advantageously enables the system 100 to identify a plurality of frequencies of a plurality of amplitudes in real-time. In an exemplary embodiment, the system 100 is configured to identify up to three frequencies, but it is foreseen that the system 100 may be configured to identify any number of frequencies, e.g., only one frequency or more than three frequencies, without deviating from the scope of the present inventive concept.

The method of using the system 100 further includes the step of determining, via the processor 202, the frequency and the amplitude of the at least one vibration mode. In the exemplary embodiment, the at least one vibration mode includes the plurality of vibration modes. It is foreseen, however, that the system 100 may be utilized with only one vibration mode without deviating from the scope of the present inventive concept. The method of using the system 100 further includes the step of determining, via the processor 202, the frequency and the amplitude of each of the plurality of vibration modes. The frequency and the amplitude of the plurality of vibration modes are stored in the non-transitory storage medium 204.

By measuring the frequency and the amplitude of each of the plurality of vibration modes, rather than only measuring a fundamental vibration mode, e.g., the lowest frequency, the system 100 is advantageously able to determine the vibration mode which is causing the most damage to the system 100, e.g., the drill-string 110, BHA 112, and/or bit 106. Furthermore, by measuring the plurality of vibration modes via the system 100, the vibration mode most likely causing the most damage to the system 100 can be more easily identified and mitigated. Also, in addition to mitigating the vibration mode at a highest energy, additional vibration modes which may be causing damage can also be reduced using the system 100.

The method of using the system 100 further includes the step of determining, via the processor 202, the controller setting 206 via the minimization of the objective function based on the reflectivity of vibration energy of the at least one vibration mode. The controller setting is configured to reduce at least one of the plurality of vibration modes, preferably a plurality of the plurality of vibration modes, and most preferably all of the plurality of vibration modes.

The step of determining the controller setting further includes performing an optimization of the measurement data based on the frequency and the amplitude of the at least one vibration mode. The optimization is effective to reduce the reflectivity of vibration energy at the at least one vibration mode. The optimization is further effective to limit a dampening of another vibration mode of the plurality of vibration modes. The optimization is performed by calculating, via the processor 202, a reflectivity of torsional waves at or adjacent to the top drive 120 of the drill-string 110, as sensed by the drill-string sensor 102, where the reflectivity of torsional waves is the equation:

$$|R(\omega)|=|((z-P)-i(\omega D-1)/\omega))/((z+P)+i(\omega D-I/\omega))| \quad (1)$$

wherein ω is an angular frequency of the reflectivity of torsional waves, z is the impedance of the drill pipe of the drill-string, i is an imaginary unit defined by its property $i^2=-1$, and P, I, and D are a proportional, an integral, and a derivative factor of the top drive 120, respectively.

The optimization is then performed, via the processor 202, by obtaining the objective function as a weighted sum of reflectivity at each frequency plus the width of the absorption band using the equation:

$$J=\sum_{i=1}^{n}[(A_i R_i(\omega_i))]+\lambda\delta\omega\sum_{i=1}^{n}A_i \quad (2)$$

wherein A_i is a measured amplitude of an i-th mode of the at least one vibration mode at a frequency ω_i, R_i is the reflectivity, δω is the half width of the absorption band calculated from Equation (1) using δω=|ω1−ω2|/2, and λ is a scalar constant. As such, if ω_0 is a frequency at which R(ω) is at a minimum R_min, ω_1 and ω_2 are two frequencies near ω_0, and R(ω) is halfway between 1 and R_min, or (1+R_min)/2, then a half distance between ω_1 and ω2, or |ω1−ω2|/2, is the half width of the absorption band, which is a frequency band where torsional vibration energy is dampened. The second term in Equation (2) prevents the system 100 from damping a wide range of frequencies, which would result in the controller setting being too soft. The scalar constant λ controls the relative weight between the two terms. It is foreseen that other implements of the second term can be used to regularize the weight between the two terms.

The method includes the step of solving the optimization numerically, via the processor 202, by applying a numerical minimization method to Equations (1) and (2) to yield a PID control. The numerical minimization method is a quasi-Newton scheme. The PID control is further processed through a moving median filter to produce a smooth output. By calculating the frequency and performing the optimization, the system 100 advantageously yields the PID control based on a dynamic description of the frequency and amplitude of the at least one vibration mode.

Figure 4:
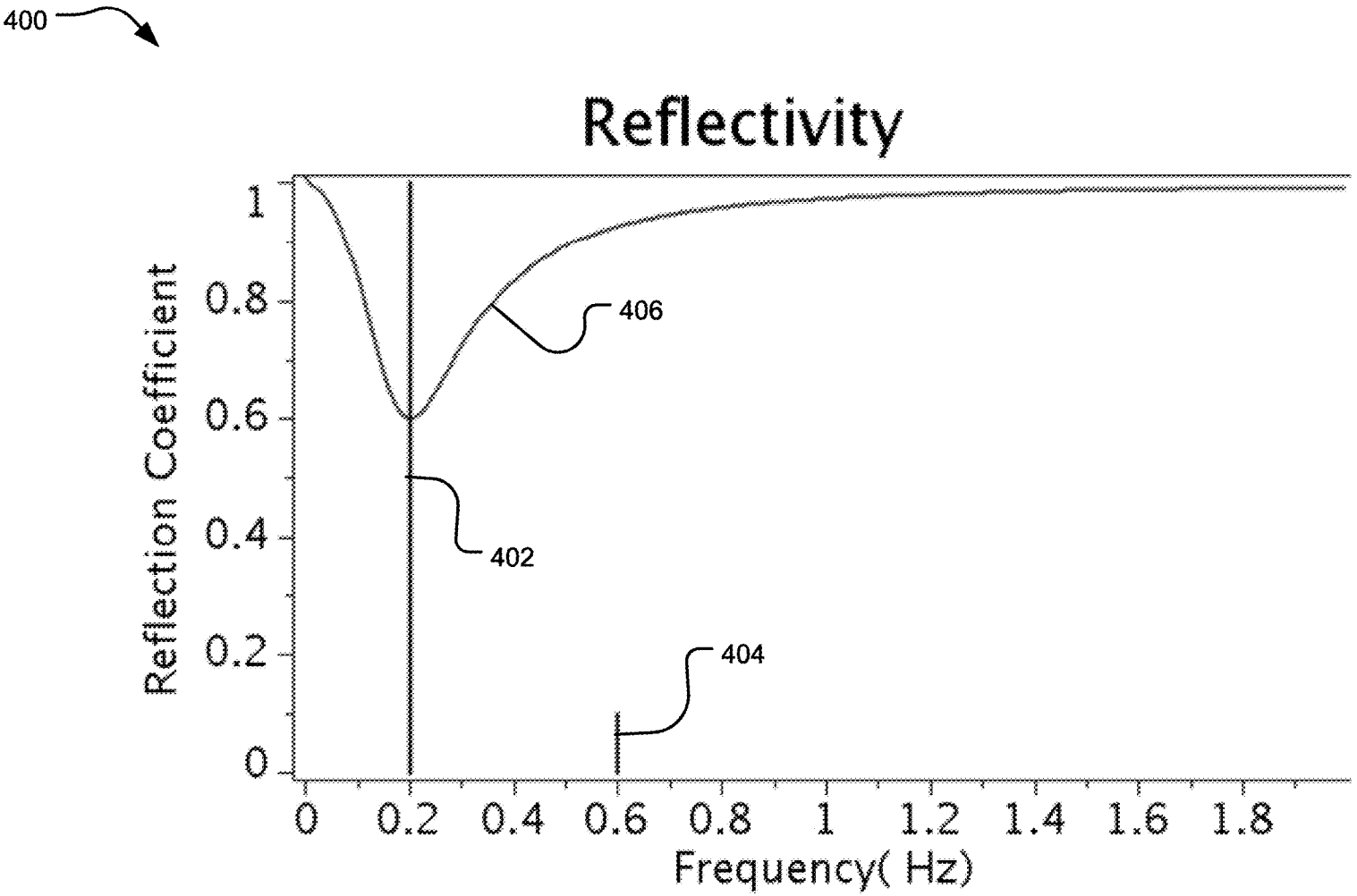
FIG. 4 is a graph illustrating a reflectivity profile when a fundamental mode is stronger than a first higher mode.
Figure 5:
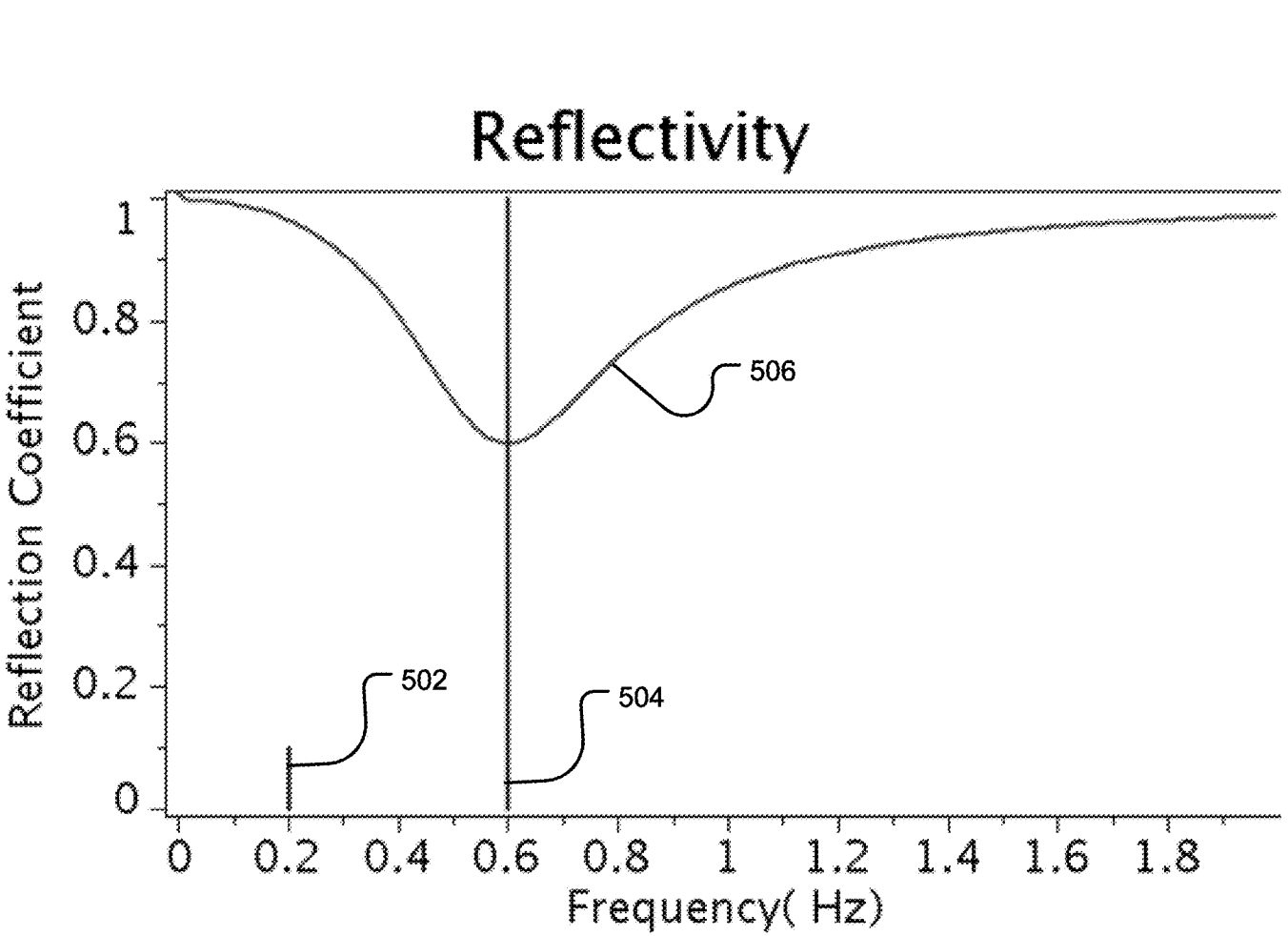
FIG. 5 is a graph illustrating the reflectivity profile when the first higher mode is stronger than the fundamental mode.
Figure 6:
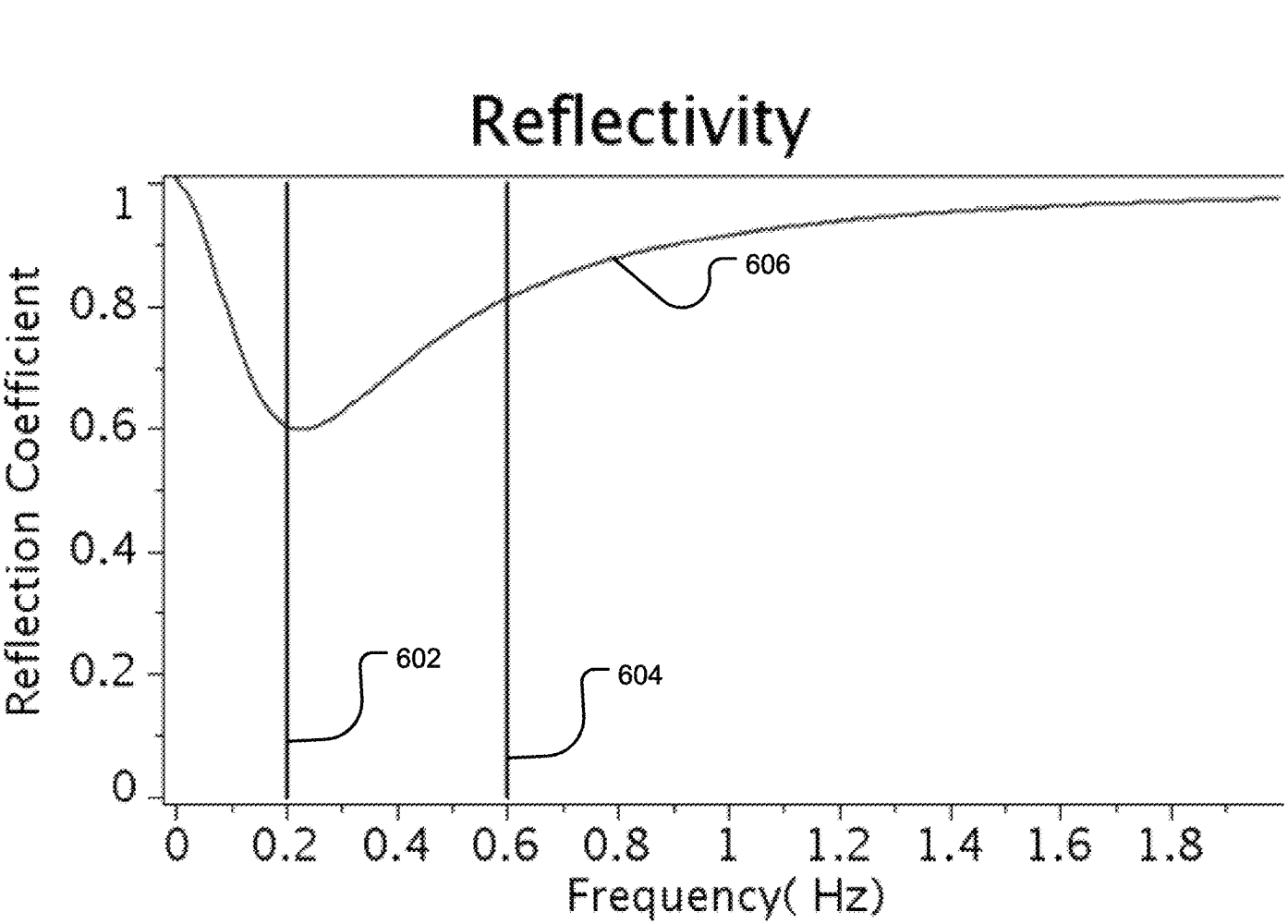

FIGS. 4-6 are respective graphs 400, 500, 600 that illustrate various reflection coefficient vs. frequency scenarios, wherein a reflectivity profile 406 generated by the system 100 of the present inventive concept is illustrated dampening modes at different strengths, i.e., a fundamental vibration mode 402 and a first higher vibration mode 404. The reflection coefficient vs. frequency graph 400 of FIG. 4 illustrates the reflectivity profile 406 when the fundamental vibration mode 402 is stronger than the first higher vibration mode 404, resulting in the reflectivity profile 406 dampening the fundamental vibration mode 402. The reflection coefficient vs. frequency graph 500 of FIG. 5 illustrates the reflectivity profile 406 when the first higher vibration mode 404 is stronger than the fundamental vibration mode 402, resulting in the reflectivity profile 406 dampening the first higher mode 404. The reflection coefficient vs. frequency graph 600 of FIG. 6 illustrates the reflectivity profile 406 when the fundamental vibration mode 402 and the first higher vibration mode 404 are similar, resulting in the reflectivity profile 406 preferentially dampening the fundamental vibration mode 602 while also partially dampening the first higher vibration mode 404. As such, the reflectivity profile 406 is not limited to only dampening the fundamental vibration mode 402, but is also capable of dampening the vibration mode with the highest energy. In this manner, the reflectivity profile 406 allows the system 100 to dampen the most damaging vibration mode, e.g., stick-slip vibration, of the system 100. Further, the reflectivity profile 406 also allows the system 100 to dampen vibration modes near the energy level of the vibration mode with the highest energy, as illustrated by FIG. 6, where both the fundamental vibration mode 402 and the first higher vibration mode 404 are dampened.

The method of using the system 100 further includes the step of controlling, via the controller 206, the drill-string 110 based on the controller setting to mitigate the at least one vibration mode. The method of using the system 100 further includes the step of determining, via the processor 202, the RPM command 314 based on the PID control. It is foreseen that the top drive 120 can be directly controlled by changing the top drive 120 control PID gains using the PID control. The RPM command 314 functions as an effective virtual PID control, which can be periodically transmitted from the controller 206 to the top drive 120 without requiring any additional access by the user to the top drive 120. For example, to change PID gains of the top drive 120, the RPM command 314 can be entered into an existing control via the user's existing access. In this manner, the system 100 is configured to make dynamic, real-time adjustments to the top drive 120 using the RPM command 314. Because the system 100 does not require additional access to any components, e.g., the top drive 120, the system 100 can be retrofitted to any drilling rig 118 regardless of top drive 120 or other components, which may be have different design configurations or otherwise vary from rig to rig.

The processor 202 is configured to calculate, via the processor 202, the RPM command 314 in a time domain and/or a frequency domain. The step of controlling the drill-string 110 using the controller setting includes calculating, via the processor 202, the RPM command 314 in the time domain using the equations:

$$P(\overline{\Omega}-\omega(t))+I\int dt(\overline{\Omega}-\omega(t))-D\frac{\partial\omega(t)}{\partial t}= P_0\left(\overline{\Omega'(t)}-\omega(t)\right)+I_0\int dt\left(\overline{\Omega'(t)}-\omega(t)\right)+D_0\left(\frac{\partial\overline{\Omega'(t)}}{\partial t}-\frac{\partial\omega(t)}{\partial t}\right) \quad (3)$$

Equation (3) reduces to a second order differential equation:

$$D_0(\delta^2X)/(\delta t^2)+P_0\delta X/\delta t+I_0X=Pe_0(t)+I\int dte_0(t)D(\delta e_0(t))/\delta t \quad (4)$$

wherein P, I, and D are from Equation (1), P_0, I_0, and D_0 are known default gains used by the drilling rig 118, ω(t) is a measured surface RPM, $(\Omega'(t))^-$ is the RPM command 314, $\Omega^-$ is a user specified RPM set point, e_0 (t)=$\Omega^-$ω(t), e_1 (t)=$\Omega'(t)^-$ω(t), and X(t)=$\int^-$ t dt e_1 (t), and wherein Equation (4) is solved numerically with initial conditions: X(0)=0, X'(0)=e_1 (0)=0.

The step of controlling the drill-string 110 using the controller setting further includes calculating, via the processor 202, the RPM command 314 in the frequency domain using the equation:

$$(\Omega(f))^-=T(f)/(Z_d(f)) \quad (5)$$

wherein T(f) is a torque signal measured at the top drive 120 and Z_d (f)=−(P+iωD+I/iω) and is a frequency dependent impedance of the top drive 120. The torque signal is transformed into the frequency domain and converted to the RPM spectra by dividing by Z_d(F), then transformed back to the time domain. A constant scalar may also be applied to the converted RPM spectra.

The time domain method calculates the RPM command 314 from the surface RPM measurement and requires a high accuracy. Sometimes the RPM measurement is not sufficiently accurate, as determined by the user, to enable use of the time domain method. For example, if a sampling rate of the RPM data 312 is too low, e.g., <10 Hz, the user may determine the RPM measurement is not sufficiently accurate to enable use of the time domain method. The frequency domain method uses the surface torque measurement, and torque is typically measured to a higher accuracy than the RPM measurement. As such, the frequency domain method may be preferred over the time domain method, in some scenarios, to calculate the RPM command 314.

The method of using the system 100 further includes the step of applying, via the processor 202, a delay program logic to the controller setting. A time delay may exist in the communication time between the drill-string sensor 102 and the controller 206, which can be mitigated by the processor 202 using the delay program logic. By executing the delay program logic, the processor 202 is able to continuously compare the RPM command 314 or the PID command to an actual RPM command or an actual PID command, so that the processor 202 is able to identify the time delay, if any. Using the delay program logic, the processor 202 is configured to determine a cross-correlation between a first signal of the controller setting and a second signal of an actual controller setting in a moving window. Using the delay program logic, the processor 202 is further configured to select a time lag corresponding to a maximum of the cross-correlation as the time delay. Using the delay program logic, the processor 202 is further configured to apply a phase shift to the first signal to offset the time delay. The phase shift is calculated, via the processor 202, using the equation:

$$\theta(f)=\omega\Delta t \tag{6}$$

wherein ω is an angular frequency of the phase shift and Δt is the time delay. The phase shift is applied, via the controller 206, by multiplying exp(iωΔt) to a spectra of the controller setting.

Figure 7:
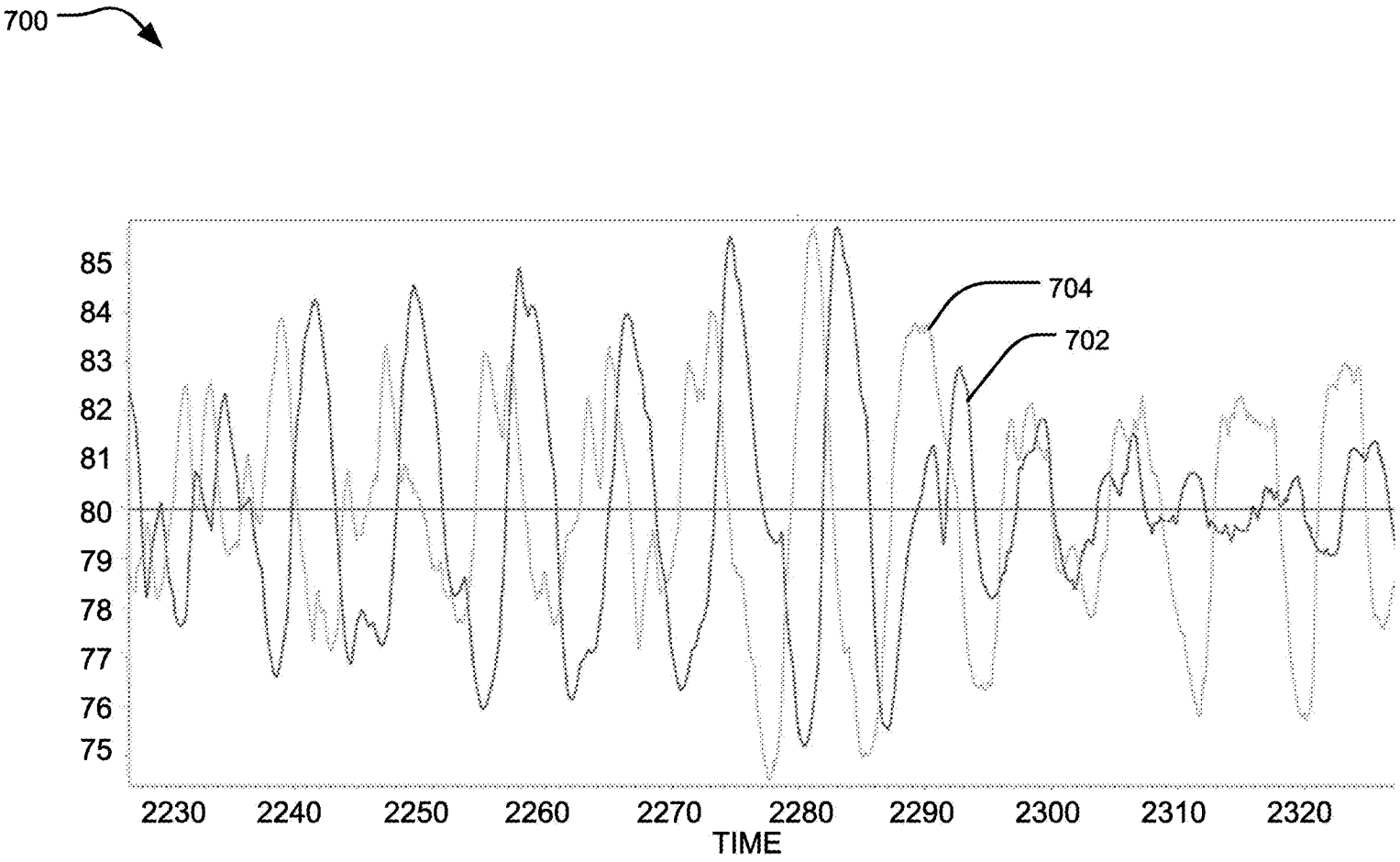
FIG. 7 is a graph of a frequency dependent phase shift.

Turning to FIG. 7, a RPM vs. time graph 700 of a frequency dependent phase shift is illustrated having an original signal 702 and a phase shifted signal 704. The phase shifted signal 704 is the original signal 702 after a phase shift has been applied to the original signal 702. It is foreseen that the time delay can be determined by other techniques without deviating from the scope of the present inventive concept. For example, the time delay may be obtained by a visual inspection of the controller setting and the actual setting. A phase shift to offset the time delay may then be manually created and applied to the controller setting using the controller 206 of the system 100.

Figure 8A:
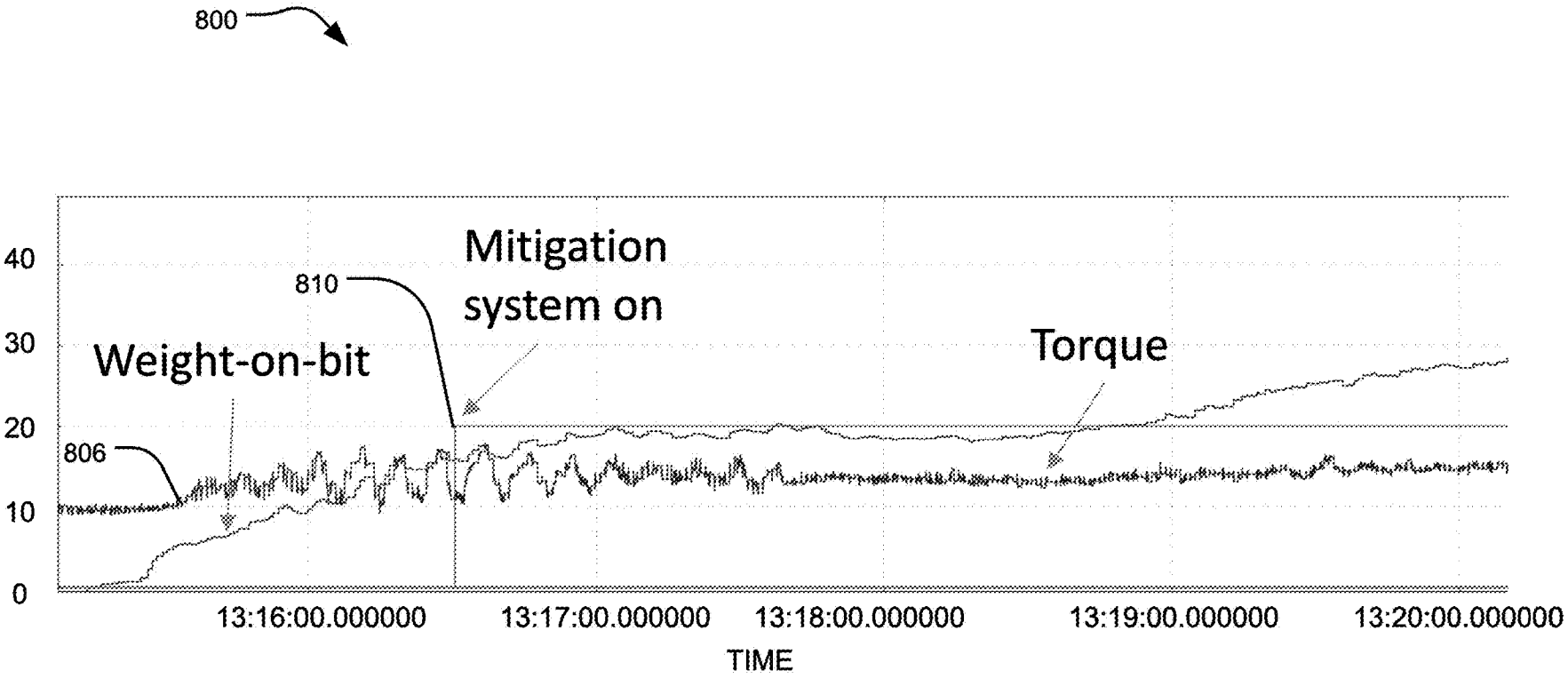
FIG. 8A is a graph illustrating weight-on-bit and torque of a field test.
Figure 8B:
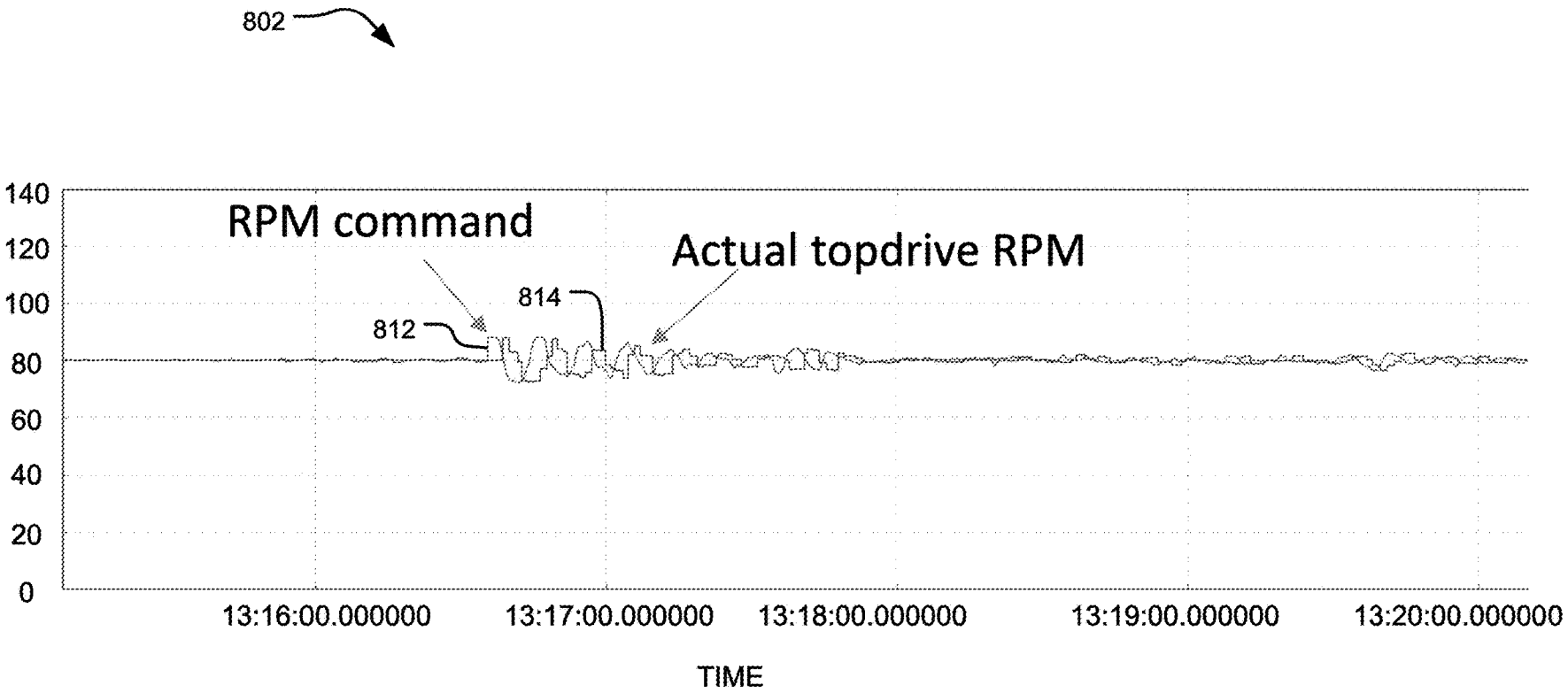
FIG. 8B is a graph illustrating an RPM command and an actual RPM of the field test.
Figure 8C:
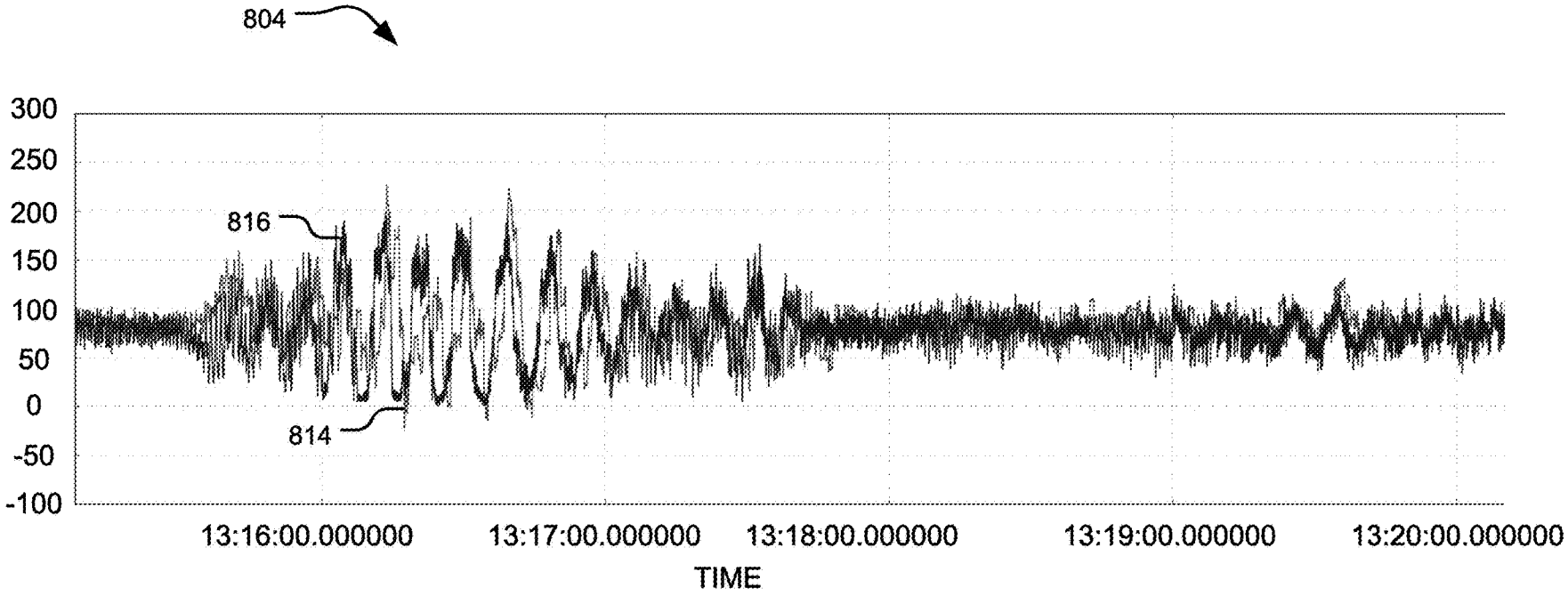
FIG. 8C is a graph illustrating a predicted RPM of a bottom hole assembly and an actual RPM of the bottom hole assembly of the field test.

Turning to FIGS. 8A-C, results from a field test using the system 100 are illustrated. FIG. 8A is a graph 800 illustrating a weight-on-bit 806 and a torque 808 of the field test. FIG. 8B is a graph 802 illustrating the RPM command 314 and an actual RPM 814 of the field test. FIG. 8C is a graph 804 illustrating a predicted RPM 818 of the BHA 112 and an actual RPM 816 of the BHA 112 of the field test. During the field test, the system 100 measured the weight-on-bit 806, the torque 808, RPM of the top drive 120, and the RPM of the BHA 112. As illustrated by FIG. 8A, both the amplitude of the torque 808 and the amplitude of the weight-on-bit 806 decreased when the system 100 was activated, thereby resulting in a smooth output. FIG. 8B illustrates a comparison between the RPM command 314 and the actual RPM 814, with the RPM command 314 controlling and smoothing the output of the measured RPM. FIG. 8C illustrates a comparison between the predicted RPM 818 and the actual RPM 816. As illustrated, the predicted BHA RPM 818 rapidly matched the measured BHA RPM 816 upon activation of the system 100, thereby causing the measured BHA RPM 816 to become smoother.

In this manner, the system 100 of the present inventive concept advantageously mitigates stick-slip vibration by targeting and reducing multiple vibration modes of the stick-slip vibration during the drilling process, thereby improving efficiency of the drilling process.

It will be appreciated by those skilled in the art that changes could be made to the embodiments described above without departing from the broad inventive concept thereof. It is understood, therefore, that the present inventive concept disclosed herein is not limited to the particular embodiments disclosed, and is intended to cover modifications within the spirit and scope of the present inventive concept.

What is claimed is:

1. A method to mitigate vibration in a drill-string, the method comprising the steps of:

measuring, via a sensor, a drill-string torque to yield measurement data;

determining, via a processor using the measurement data, a plurality of vibration modes of a drill-string;

determining, via the processor, a frequency and an amplitude of each of the plurality of vibration modes;

determining, via the processor, a controller setting via a minimization of an objective function based on a reflectivity of vibration energy of the plurality of vibration modes by performing an optimization of the measurement data based on the frequency and the amplitude of each of the plurality of vibration modes; and controlling, via a controller, the drill-string based on the controller setting to mitigate the plurality of vibration modes, wherein the optimization includes reducing the reflectivity of the vibration energy of one of the plurality of vibration modes, and limiting a dampening of another of the plurality of vibration modes, and wherein the optimization is performed by calculating a reflectivity of torsional waves at a top drive of the drill-string using the equation:

$$|R(\omega)|=|((z-P)-i(\omega D-1)/\omega))/((z+P)+i(\omega D-I/\omega))| \tag{1},$$

wherein ω is an angular frequency of the reflectivity of torsional waves, z is impedance of a drill pipe of the drill-string, and P, I, and D are a proportional factor, an integral factor, and a derivative factor of the top drive, respectively.

2. The method of claim 1, wherein, the controller setting is configured to reduce all of the plurality of vibration modes.

3. The method of claim 1, wherein, the optimization is performed by obtaining the objective function as a weighted sum of reflectivity at each frequency plus a width of an absorption band using the equation:

$$J=\sum_{i=1}^{n}[(A_i R_i(\omega_i))]+\lambda\delta\omega\sum_{i=1}^{n}A_i \tag{2}$$

wherein A_i is a measured amplitude of an i-th mode of the plurality of vibration modes at a frequency ω_i, δω is a half width of the absorption band calculated from Equation (1), and λ is a scalar constant.

4. The method of claim 3, wherein, the optimization includes solving the optimization numerically by applying a numerical minimization method to Equations (1) and (2) to yield a PID control.

5. The method of claim 4, further comprising the step of:

determining, via the processor, an RPM command based on the PID control.

6. A system configured to mitigate vibration in a drill-string, the system comprising:

a sensor is configured to measure a torque of the drill-string, and yield measurement data;

a processor;

a non-transitory storage medium configured to store program logic for execution by the processor to cause the processor to: determine a plurality of vibration modes of the drill-string using the measurement data, determine a controller setting via minimization of an objective function based on a reflectivity of vibration energy of the plurality of vibration modes, wherein the controller setting is configured to reduce all of the plurality of vibration modes, determine a frequency and an amplitude of each of the plurality of vibration modes, and determine an optimization of the controller setting based on the frequency and the amplitude of each of the plurality of vibration modes;

a controller configured to control the drill-string based on the controller setting to mitigate the plurality of vibration modes;

wherein the optimization includes reducing the reflectivity of the vibration energy of one of the plurality of vibration modes and limiting a dampening of another of the plurality of vibration modes; and wherein the processor is further configured to calculate a reflectivity of torsional waves at a top drive of the drill-string using the equation:

$$|R(\omega)|=|((z-P)-i(\omega D-1)/\omega))/((z+P)+i(\omega D-I/\omega))| \quad (1)$$

wherein ω is an angular frequency of the reflectivity of torsional waves, z is impedance of a drill pipe of the drill-string, and P, I, and D are a proportional factor, an integral factor, and a derivative factor of the top drive, respectively.

7. The system of claim 6, wherein, the controller setting is an RPM command.

8. The system of claim 6, wherein, the processor is configured via program logic to perform a spectral analysis of the measurement data to yield a spectral content.

9. The system of claim 6, wherein, the processor is configured to obtain the objective function as a weighted sum of reflectivity at each frequency plus a width of an absorption band using the equation:

$$J = \sum_{i=1}^{n} [(A_i R_i(\omega_i))] + \lambda\delta\omega \sum_{i=1}^{n} A_i \quad (2)$$

wherein A_i is a measured amplitude of an i-th mode of the plurality of vibration modes at a frequency ω_i, δω is a half width of the absorption band calculated from Equation (1), and λ is a scalar constant.

10. The system of claim 9, wherein, the processor is configured to solve the optimization numerically by applying a numerical minimization method to Equations (1) and (2) to yield a PID control.

11. The system of claim 10, wherein, the processor is configured to determine an RPM command based on the PID control, wherein the RPM command can be implemented in either a time domain or a frequency domain.

12. The system of claim 11, wherein, the processor is configured to calculate the RPM command in the time domain by solving the equations:

$$P(\overline{\Omega} - \omega(t)) + I\int dt(\overline{\Omega} - \omega(t)) - D\frac{\partial\omega(t)}{\partial t} = P_0(\overline{\Omega'(t)} - \omega(t)) + I_0\int dt(\overline{\Omega'(t)} - \omega(t)) + D_0\left(\frac{\partial\overline{\Omega'(t)}}{\partial t} - \frac{\partial\omega(t)}{\partial t}\right) \quad (3)$$

wherein Equation (3) reduces to equation:

$$D_0(\delta^2 X)/(\delta t^2)+P_0\delta X/\delta t+I_0 X=Pe_0(t)+I\int dte_0(t)D(\delta e_0(t))/\delta t \quad (4)$$

wherein P, I, and D are from Equation (1), P_0, 1_0, and D_0 are known default gains used by a drilling rig, w(t) is a measured surface RPM, $(\Omega'(t))^-$ is the RPM command, and $\Omega^-$ is a user specified RPM set, e_0 (t)= $\Omega^-\omega(t)$, e_1 (t)=$\Omega'(t)^-\omega(t)$, and X(t)=$\int^-$ t dt e_1 (t), and wherein Equation (4) is solved numerically with initial conditions: X(0)=0, X'(0)=e_1 (0)=0.

* * * * *